US011525584B2

(12) United States Patent
Volo

(10) Patent No.: US 11,525,584 B2
(45) Date of Patent: Dec. 13, 2022

(54) METHOD OF MODIFYING AIR CONDITIONER FOR HEATING

(71) Applicant: Giovanni D. Volo, Meriden, CT (US)

(72) Inventor: Giovanni D. Volo, Meriden, CT (US)

( * ) Notice: Subject to any disclaimer, the term of this patent is extended or adjusted under 35 U.S.C. 154(b) by 0 days.

(21) Appl. No.: 15/487,344

(22) Filed: Apr. 13, 2017

(65) Prior Publication Data

US 2018/0299141 A1 Oct. 18, 2018

(51) Int. Cl.
*F24D 15/02* (2006.01)
*F24D 15/04* (2006.01)

(52) U.S. Cl.
CPC ..... *F24D 15/02* (2013.01); *F24D 15/04* (2013.01); *F24D 2200/31* (2013.01)

(58) Field of Classification Search
CPC ..... F24D 15/02; F24D 15/04; F24F 1/025; F24F 13/0209
See application file for complete search history.

(56) References Cited

U.S. PATENT DOCUMENTS 2,945,357 A 7/1960 MacLeod
3,048,095 A 8/1962 MacLeod
3,438,219 A * 4/1969 Brugler ..... F24F 1/02 62/262
3,668,887 A 6/1972 Riello
4,337,823 A 7/1982 DelPercio
4,635,445 A * 1/1987 Otsuka ..... F24F 3/0442 62/158
5,184,475 A * 2/1993 Matsumi ..... F24F 1/027 312/101
6,167,714 B1 * 1/2001 Baffes ..... F24F 1/025 62/188
9,080,801 B2 7/2015 Arjomand
2001/0035023 A1 11/2001 Kuo
2002/0121101 A1 * 9/2002 Jebaraj ..... F24F 1/025 62/259.1

(Continued)

FOREIGN PATENT DOCUMENTS

CN 102207311 A 10/2011

OTHER PUBLICATIONS

Franklin Hu, Turning an airconditioner into a heat pump by turning it around, Nov. 3, 2014, YouTube https://www.youtube.com/watch?v=Qf4ZYsACP9k.*

(Continued)

*Primary Examiner* — Nael N Babaa
(74) *Attorney, Agent, or Firm* — Nath, Goldberg & Meyer; Richard C. Litman

(57) ABSTRACT

The method of modifying an air conditioner for heating takes advantage of the features and operation of a conventional limited space air conditioner, preferably a portable room air conditioner. A hood or manifold is placed over the vents or grille that normally exhausts cold air into the room, and a flexible duct hose is connected between the hood or duct and an exhaust vent installed in a window or ceiling to exhaust cold air produced by the air conditioner outside the building. The duct from the condenser or hot air side of the air conditioner, which would normally be exhausted outside the building, is open to the room in need of heating. Thus, the hot air produced by normal operation of the air conditioner is used to heat the room.

2 Claims, 2 Drawing Sheets

(56) References Cited

U.S. PATENT DOCUMENTS

| | | | | |
|---|---|---|---|---|
| 2007/0271938 | A1* | 11/2007 | Shaffer | F25B 27/00 62/228.1 |
| 2008/0104988 | A1* | 5/2008 | Lee | F24F 1/025 62/285 |
| 2012/0090344 | A1 | 4/2012 | Cho et al. | |
| 2013/0133351 | A1* | 5/2013 | Kil | F24F 13/222 62/291 |
| 2017/0038090 | A1* | 2/2017 | Bianchi | F24F 13/0209 |
| 2018/0023568 | A1* | 1/2018 | Kang | F01C 21/10 361/689 |

OTHER PUBLICATIONS

Marshall Brian, et al., "How Air Conditioners Work" 2018, Full Document (Year: 2018).*

* cited by examiner

METHOD OF MODIFYING AIR CONDITIONER FOR HEATING

BACKGROUND OF THE INVENTION

1. Field of the Invention

The present invention relates to heating, ventilation, and air conditioning (HVAC) systems, and particularly to a method of modifying an air conditioner for heating.

2. Description of the Related Art

Many older buildings, e.g., historical buildings, were constructed in the days before central air conditioning systems and heat pump systems became common. The cost of retrofitting such buildings is often impractical, and in historical districts, the installation of ductwork may destroy architectural features that local zoning regulations are designed to preserve. In addition, many detached or semi-detached structures, such as sheds, workrooms, garages, etc., become very warm in the summer and cold in the winter. A common solution for the summer heat is a limited space air conditioner, such as a window air conditioner or a portable room air conditioner. During cold weather, heat may be provided by a radiator, by baseboard electric heaters, by kerosene space heaters, or the like.

Nevertheless, such heating systems are often inefficient or require supplemental heating. In addition, the use of separate systems to provide heating and cooling is energy inefficient. It would be desirable to use a limited space air conditioner to produce not only air conditioning, but heating when needed. Thus, a method of modifying an air conditioner for heating solving the aforementioned problems is desired.

SUMMARY OF THE INVENTION

The method of modifying an air conditioner for heating takes advantage of the features and operation of a conventional limited space air conditioner, preferably a portable room air conditioner. A hood or manifold is placed over the vents or grille that normally exhausts cold air into the room, and a flexible duct hose is connected between the hood or duct and an exhaust vent installed in a window or ceiling to exhaust cold air produced by the air conditioner outside the building. The duct from the condenser or hot air side of the air conditioner, which would normally be exhausted outside the building, is open to the room in need of heating. Thus, the hot air produced by normal operation of the air conditioner is used to heat the room.

A window air conditioner may also be modified to provide heating in the same manner. However, in this case, the window air conditioner is operated entirely within the room to be heated, and the cold air normally produced by the air conditioner is exhausted outside the building by a flexible duct hose, as described above. It can be seen that using the above method of modifying an air conditioner, no defrost control is involved in the process. In the heating mode, there is little to no condensation (as opposed to the water condensate which much be drained from a cooling air conditioner). When the air conditioning unit is used in the heating mode, air from the condenser 106 is discharged into the room to be heated, and the cooled air passing over the condenser coil is vented either outside or, alternatively, into a separate space that requires air conditioning (such as a computer room, an HVAC system, etc.), thus conserving energy. It should be understood that the method of modifying an air conditioner for heating may be applied to any desired type of air conditioner system. For example, the method may be used to modify window air conditioner units, portable air conditioners, package roof top heating systems, systems used for computer rooms, as an example, HVAC systems, etc.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The method of modifying an air conditioner for heating takes advantage of the features and operation of a conventional limited space air conditioner, preferably a portable room air conditioner. A hood or manifold is placed over the vents or grille that normally exhausts cold air into the room, and a flexible duct hose is connected between the hood or duct and an exhaust vent installed in a window or ceiling to exhaust cold air produced by the air conditioner outside the building. The duct from the condenser or hot air side of the air conditioner, which would normally be exhausted outside the building, is open to the room in need of heating. Thus, the hot air produced by normal operation of the air conditioner is used to heat the room.

Figure 1:
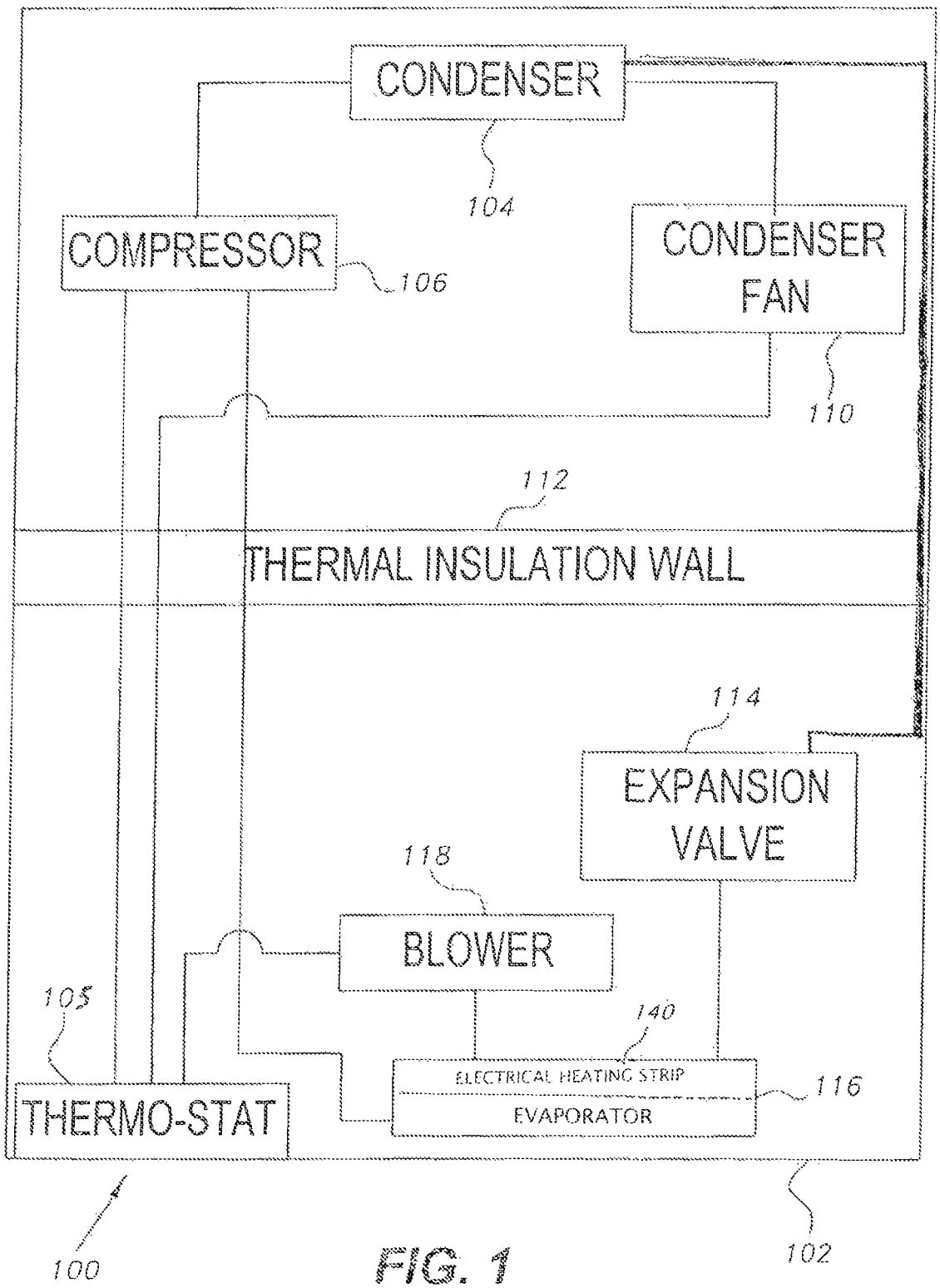
FIG. 1 is a block diagram of the refrigerant system components of a typical limited space air conditioner.

FIG. 1 shows the typical components of the refrigerant system of a limited space air conditioner 100. The air conditioner includes a cabinet or housing 102. A compressor 106, condenser 104, and condenser fan 110 are disposed on the hot side of the cabinet 102. An expansion valve 114, evaporator 116, and blower fan 118 are disposed on the cold side of the cabinet 102. Typically a wall of thermal insulation 112 will separate the room air (or cold side) from the outside air (or hot side) inside the cabinet 102. A thermostat 105 and other controls will be mounted on the cabinet 102. A window air conditioner will usually be mounted in the window with the condenser 104, compressor 106, and condenser fan 110 mounted outside the window. A portable room air conditioner will have all of these components disposed inside the cabinet 102 in the room to be cooled, with a flexible duct or exhaust hose connected between the condenser 104 and a window or ceiling vent to exhaust the hot air outside the building.

In operation as an air conditioner, when the temperature inside the room exceeds the temperature set on the thermostat 105, the compressor 106 turn on and compresses the refrigerant. The condenser fan 110 draws outside air (or room air) in and over the condenser coil. Even though the outside air is warm, it is still cooler than the refrigerant, which is hot and under high pressure, so that heat exchange with the outside air cools the refrigerant to a liquid in the condenser, while the hot air is blown outside by the condenser fan 110. The refrigerant is pumped to the expansion valve, where the refrigerant expands to a gas and is further cooled by expansion in the evaporator 116. The evaporator coil is cool almost immediately. The blower motor or blower fan 118 turns on and draws room air into the cabinet 102 and across the cold evaporator coils, where the room air is cooled and blown back into the room. The gaseous refrigerant is pumped from the evaporator 116 to the compressor 106, and the cycle is repeated until the room air is cooled. Any humidity in the room air is exhausted outside the building by the condenser fan 110, or condenses inside the cabinet 102 and drops to a collection tray, which is periodically empty.

Figure 2:
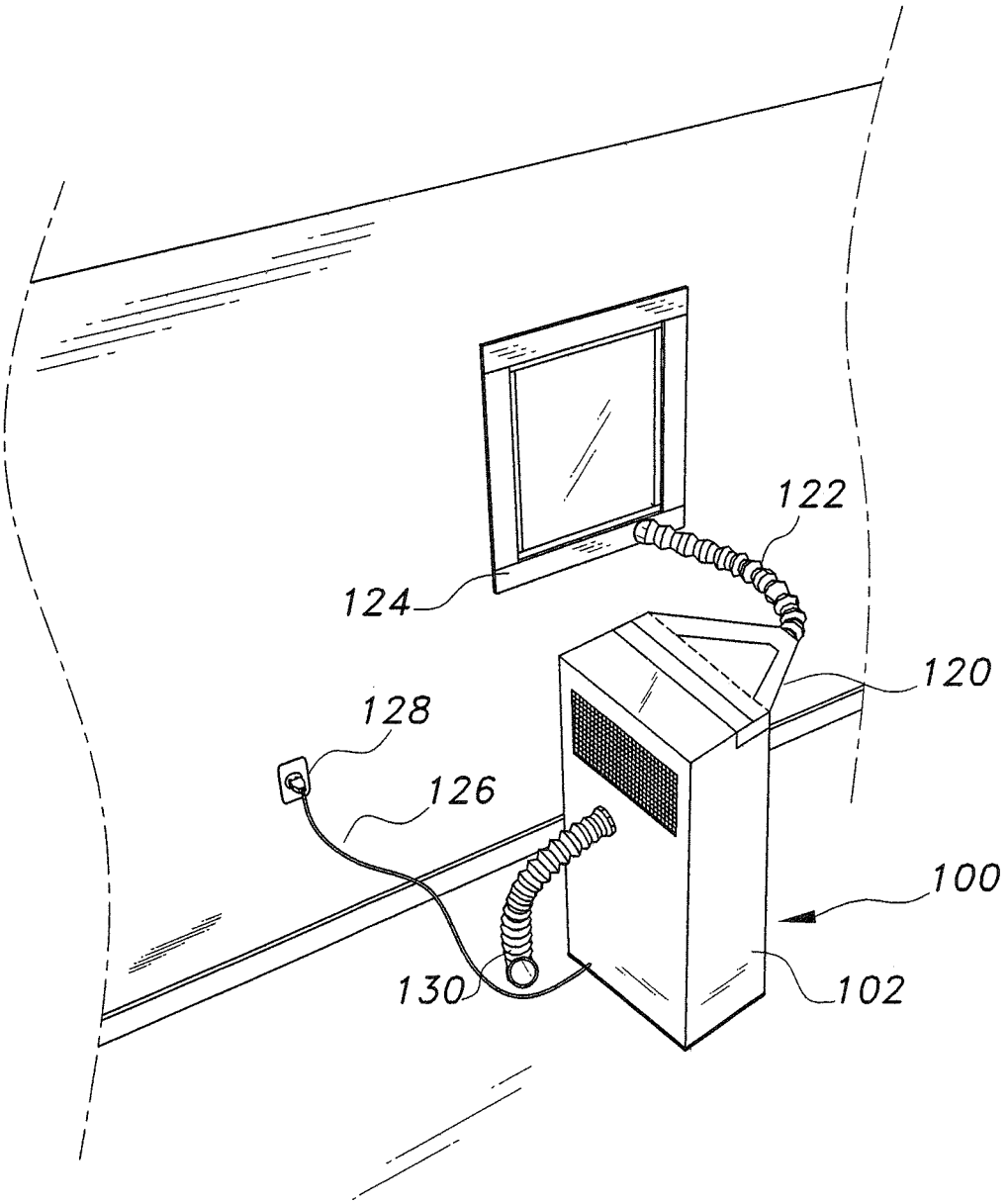
FIG. 2 is an environmental perspective view of a portable room air conditioner modified to supply heat according to the method of modifying an air conditioner for heating according to the present invention.

FIG. 2 shows a portable room air conditioner 100 modified to heat the room. A hood 120 is placed over the vents on the front panel of the cabinet 102 that would normally be used to return room air cooled by the evaporator 116 into the room. Instead, a flexible duct or exhaust hose 122 is connected between the hood 120 and a window vent. The hood 120 may be made from flexible thermal insulation with aluminum backing and secured to the cabinet 102 by duct tape or the like. Alternatively, depending upon the size of the cool air vents, a pyramidal or horn-shaped section of sheet metal duct may be secured to the cabinet 102 by screws or other fasteners and sealed by a gasket or by caulk. A sheet metal plate may be attached across the open end of the sheet metal duct, and a circular flange may be provided for attachment of the flexible duct 122. In any event, the cold air produced by the air conditioner 100 is vented outside.

The flexible hose 130 attached to the rear of the cabinet, which receives the hot air from the compressor 106 and the condenser 104 and which is exhausted by the condenser fan 110, is open into the room to be heated. Thus, the heat normally produced by operation of the air conditioner is used to heat the room. Although illustrated by a portable room air conditioner in FIG. 2, the same principles may be used to modify a window air conditioner for heating. The cabinet of the window air conditioner would be placed completely inside the room to be heated, the cold air vents would be covered by a hood or manifold and ducted outside the building through a window or ceiling vent, and the hot air vents would be open to the interior of the room to be heated.

Reversal of operation of the air conditioning unit may be controlled easily without requiring, for example, a reversing valve. A bypass hose, along with any associated connectors, ductwork, dampers, etc., may be used to transfer thermal energy directly from the air conditioner's condenser 106 to its evaporator 116. In operation, this increases the load on the condenser 106 to produce more heat. As room temperature increases, a modulator or modulation controller may be used to slowly close off the damper to slow or cease venting of the heated air into the room. Preferably, the dampers are motorized dampers or the like, although manual dampers may also be used.

The above operation may be used on cold startup or as required. When the air conditioning side of the system requires more of a load on the evaporator 116 to create more heat, the damper will open or close, as needed, from the condenser 106 to the evaporator 116. As an alternative, electrical heating strip 140 or the like may be added to create a load on evaporator 116. The present method of modifying an air conditioner allows a single unit to be used all year, operating in both a cooling air conditioning mode as well as in a heating mode. In addition to the manual or automatic switching of operation described above, a further alternative includes the addition of a modulated reversible motor, allowing for the controllable change of air direction.

It can be seen that using the above method of modifying an air conditioner, no defrost control is involved in the process. In the heating mode, there is little to no condensation (as opposed to the water condensate which much be drained from a cooling air conditioner). When the air conditioning unit is used in the heating mode, air from the condenser 106 is discharged into the room to be heated, and the cooled air passing over the condenser coil is vented either outside or, alternatively, into a separate space that requires air conditioning (such as a computer room, an HVAC system, etc.), thus conserving energy.

It should be understood that the method of modifying an air conditioner for heating may be applied to any desired type of air conditioner system. For example, the method may be used to modify window air conditioner units, portable air conditioners, package roof top heating systems, systems used for computer rooms, as an example, HVAC systems, etc. Similarly, it should be understood that the present method may be used in combination with any conventional type of air conditioner controller, such as, for example, conventional thermostats, timers, programmable systems including programmable logic controllers and the like, sensors, remote controls, direct user interfaces (buttons, switches, etc.), telephone control and the like. Further, it should be understood that conventional air conditioner components may be used with the modified air conditioner, such as, for example, conventional filters and the like for filtering the air from the supply and the return.

It should be understood that the components used in the present method, such as flexible hose 130, hood 120, the optional bypass hose, along with any associated connectors, ductwork, venting, etc., may be made from any suitable material, such as, but not limited to, metal, plastic, carbon, carbon fiber or the like. Similarly, any connectors, hardware, fixtures, fittings and the like may be formed from any suitable material, and any suitable type of connections may be used, such as, for example, Velcro®, straps, screws, etc.

It is to be understood that the present invention is not limited to the embodiments described above, but encompasses any and all embodiments within the scope of the following claims.

I claim:

1. A method of modifying an air conditioner for heating a room, comprising the steps of:

providing an air conditioner, the air conditioner including:

a) a housing, the housing having front, rear, top, and bottom surfaces, wherein the interior of the housing has two compartments separated by a wall of thermal insulation, the housing having vents on the front surface of the housing;

b) a thermostat mounted on the housing;

c) a compressor, a condenser, and a condenser fan disposed in one of the two compartments and defining a hot side of the housing;

d) an expansion valve, an evaporator, and blower fan disposed in the second of the two compartments and defining a cold side of the housing;

e) an exhaust hose in communication with the cold side of the housing and being connected to the housing and exiting from either the front or rear surfaces;

f) a hose attached to the rear surface of the housing and being in communication with the hot air from the compressor and the condenser and exhausted by the condenser fan into the room to be heated;

g) the condenser being in fluidic communication with the evaporator via the expansion valve in order to transfer thermal energy directly from the condenser to the evaporator;

covering the vents of the air conditioner with a hood;

extending the exhaust hose between the hood and an exterior environment away from the room to be heated; and circulating hot air from the hot side of the housing inside the room to be heated.

2. The method of modifying an air conditioner for heating a room according to claim 1, wherein the evaporator includes an electrical heating strip intended to create a load on the evaporator.

* * * * *